US006401814B1

(12) United States Patent
Owens et al.

(10) Patent No.: US 6,401,814 B1
(45) Date of Patent: Jun. 11, 2002

(54) METHOD OF LOCATING A CEMENTING PLUG IN A SUBTERRANEAN WALL

(75) Inventors: Steven C. Owens, The Woodlands; David S. Kulakofsky, Katy, both of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/711,665

(22) Filed: Nov. 9, 2000

(51) Int. Cl.[7] ..... E21B 33/16; E21B 47/06

(52) U.S. Cl. ..... 166/253.1; 73/152.57; 166/255.1; 166/250.14; 166/291

(58) Field of Search ..... 166/64, 66, 253.1, 166/255.1, 250.14, 291; 73/152.57; 367/99

(56) References Cited

U.S. PATENT DOCUMENTS 3,265,151 A * 8/1966 Anderson ..... 166/250.14
3,637,038 A * 1/1972 Tanner ..... 166/255.1
4,093,028 A * 6/1978 Brandon ..... 166/281
4,548,271 A * 10/1985 Keller ..... 166/285
4,819,726 A * 4/1989 Beirute et al. ..... 166/156
4,907,649 A * 3/1990 Bode ..... 166/255.1 X
5,377,160 A * 12/1994 Tello et al. ..... 166/253.1
5,754,495 A 5/1998 Skinner
5,829,523 A * 11/1998 North ..... 166/155
5,967,231 A * 10/1999 Laurel et al. ..... 166/250.04
6,053,245 A * 4/2000 Haberman ..... 166/250.14
6,125,935 A * 10/2000 Shahin, Jr. ..... 166/250.14
6,333,699 B1 * 12/2001 Zierolf ..... 166/255.1 X

OTHER PUBLICATIONS

Echometer–3 Web Pages (dated; Oct. 16, 2000).

* cited by examiner

*Primary Examiner*—George Suchfield
(74) *Attorney, Agent, or Firm*—Paul I. Herman; Marlin R. Smith

(57) ABSTRACT

A method is provided which, in an embodiment described herein, permits a location and/or displacement of a cementing plug to be determined during a cementing operation. In this embodiment, one or more pressure pulses are transmitted through displacement fluid being used to pump the plug through the casing string. The pressure pulses are reflected off of the plug and received by a pressure sensor. Information regarding the timing of the reflected pressure pulses may be used to determine the location and/or displacement of the plug.

45 Claims, 4 Drawing Sheets

METHOD OF LOCATING A CEMENTING PLUG IN A SUBTERRANEAN WALL

BACKGROUND

The present invention relates generally to operations performed in conjunction with a subterranean well and, in an embodiment described herein, more particularly provides a method of locating a cementing plug.

It is general practice in well cementing operations to use a top plug to separate cement pumped into a casing string from fluid used to displace the cement through the casing string. The fluid used to displace the plug, and thereby displace the cement, through the casing string is typically water, brine or mud.

A predetermined volume of the displacement fluid is pumped into the casing string on top of the plug. The volume of the displacement fluid pumped into the casing string on top of the plug is usually equal to the internal volume of the casing string. In this manner, the plug is pumped to the bottom end of the casing string, and the cement formerly in the casing string is displaced into an annulus formed between the casing string and the wellbore.

When the plug arrives at the bottom end of the casing string it lands in a float shoe or collar which is specially designed to receive the plug. After the plug lands in the float shoe, continued pumping of displacement fluid into the casing string will result in a noticeable pressure increase within the casing, thereby giving an indication that the plug has landed in the float shoe or collar.

Ideally, the plug lands in the float shoe at the same time as the predetermined volume of displacement fluid has been pumped into the casing string. Unfortunately, however, circumstances are not always ideal. For example, the plug may be released into the casing string late, that is, after the displacement fluid has already begun to be pumped into the casing string. In this situation, it would be preferred to stop pumping the displacement fluid before the plug lands in the float shoe, so that the displacement fluid introduced into the casing string before the plug was released will not be displaced into the annulus. As another example, due to pumping inefficiencies and/or other difficulties, the exact volume of displacement fluid pumped into the casing string may not be known, thereby making it difficult to know how far the plug has been displaced through the casing string.

From the foregoing, it can be seen that it would be quite desirable to provide a method which permits the location and/or displacement of a cementing plug in a casing string to be determined. It is accordingly an object of the present invention to provide such a method. Another object of the invention is to provide methods usable for other applications, as well.

SUMMARY

In carrying out the principles of the present invention, in accordance with an embodiment thereof, a method is provided which utilizes pressure pulses transmitted during a cementing operation to determine a location and displacement of a plug in a casing string.

In one aspect of the invention, one or more pressure pulses are applied to the displacement fluid as it is being pumped into the casing string on top of the plug. If the speed of the pulse through the displacement fluid is known, then a difference in time between pulses reflected off of the plug will relate to a displacement speed of the plug. This information may be used to determine whether the plug is displacing in response to the displacement fluid being pumped into the casing string.

In another aspect of the invention, one or more pressure pulses reflected off of the plug may be used to accurately determine the location of the plug in the casing string, or to estimate the location. For the most accurate determination, a pressure pulse is transmitted through the displacement fluid a known distance, and the speed of the pressure pulse through the displacement fluid is determined before the displacement fluid is used to pump the plug through the casing string. Thus, when a pressure pulse is later transmitted through the displacement fluid and reflected off of the plug during the cementing operation, the speed of the pressure pulse through the fluid will be accurately known for use in calculating the location of the plug. For estimating the location of the plug, an approximate speed of the pressure pulse through the displacement fluid may be used.

In yet another aspect of the invention, the location of the plug may be estimated by transmitting a pressure pulse through the fluid in the casing string and counting reflections of the pressure pulse due to known anomalies in the casing string. For example, pressure pulse reflections due to collars in the casing string may be received prior to receiving a reflection due to the plug. By counting the number of the collar reflections prior to the plug reflection, the location of the plug in the casing string maybe estimated within the length of one joint of casing.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
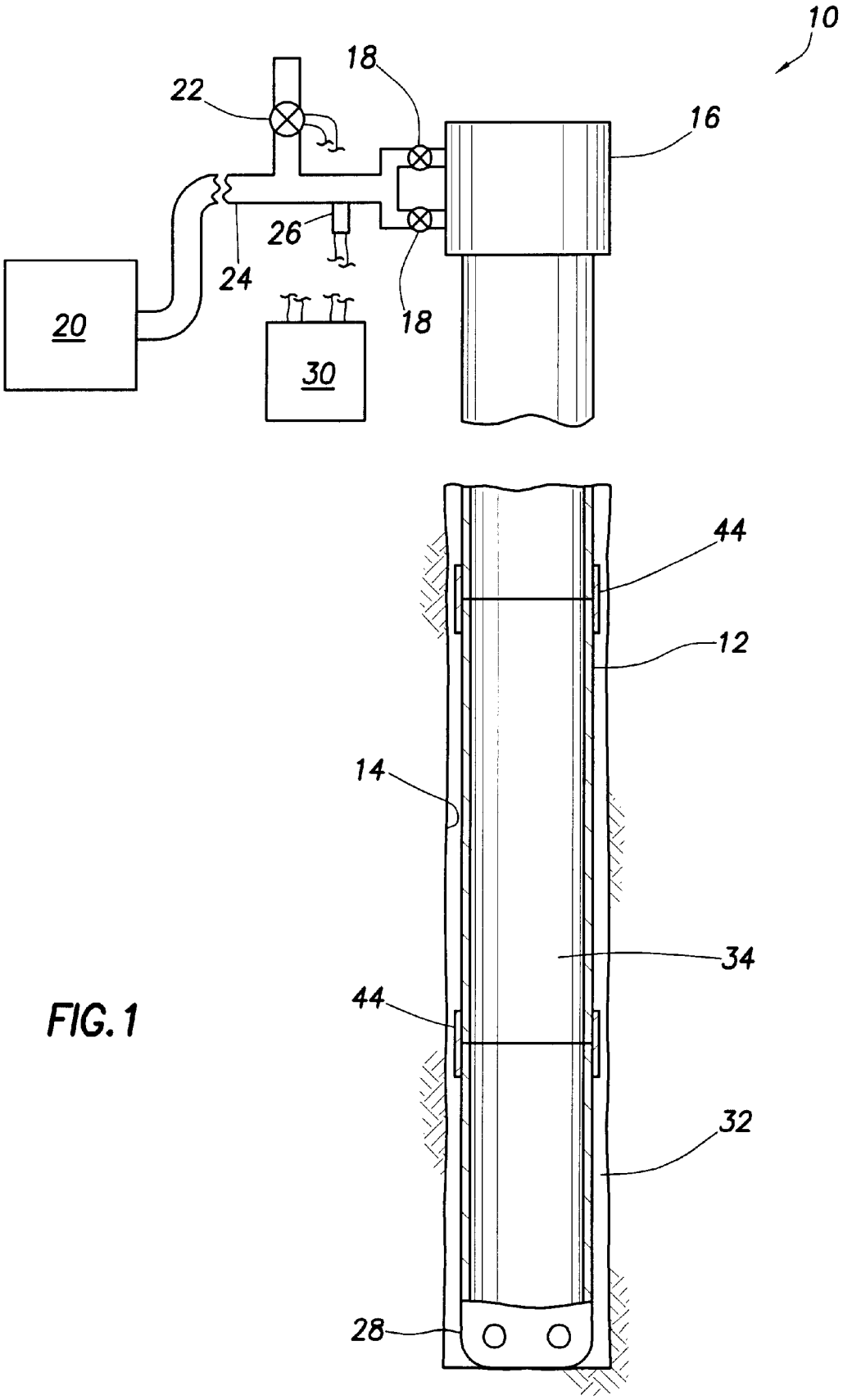
FIG. 1 is a schematic partially cross-sectional view of a method embodying principles of the present invention, wherein a casing string has been positioned in a wellbore.

Representatively illustrated in FIG. 1 is a method lo which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein maybe utilized in various orientations, such as inclined, inverted, horizontal, vertical, etc., and in various configurations, without departing from the principles of the present invention.

The method 10 utilizes pressure pulses to determine the location and/or displacement of a cementing plug in a casing string 12 positioned in a wellbore 14. The use of pressure pulses for determining the length of a fluid conduit in a wellbore is described in U.S. Pat. No. 5,754,495, the entire disclosure of which is incorporated herein by this reference.

Methods of transmitting and receiving pressure pulses through fluid conduits described in that patent are not repeated herein.

In the method 10, the length of the casing string 12 is known, and so a different problem is presented as compared to that resolved in U.S. Pat. No. 5,754,495. A cementing operation is to be performed in the method 10, wherein a cementing plug is released into the casing string 12, and the problem is how to determine the plug's location in, and/or displacement through, the casing string. Of course, it will be readily appreciated that principles of the present invention may be successfully applied in other methods wherein a device is displaced through a tubular string.

A conventional plug release head 16 is connected at an upper end of the casing string 12. The release head 16 is used to release the plug into the casing string 12 at an appropriate point in the cementing operation. Valves 18 are connected between the release head 16 and a pump 20. The pump 20 is used to pump cement and displacement fluid (such as water, mud, brine, etc.) through the casing string 12.

Another valve 22 is interconnected to a flowline 24 extending between the pump 20 and the valves 18. The valve 22 is used to transmit pressure pulses via the flowline 24 to the fluid in the casing string 12. Specifically, the valve 22 is opened momentarily to vent pressure from the flowline 24 and, thus, transmit a negative pressure pulse through the fluid in the casing string 12.

However, other methods of transmitting pressure pulses through the fluid in the casing string 12 may be used, without departing from the principles of the present invention. For example, a device known to those skilled in the art as an air gun may be used to transmit a positive pressure pulse through the fluid in the casing string 12. As another example, the pump 20 may be operated in such a manner as to transmit a pressure pulse, such as by varying the pump's motor speed or by momentarily disengaging the motor from the pump, etc.

A pressure transducer 26 is connected to the flowline 24. The transducer 26 is used to determine the timing of various events related to transmission of pressure pulses and reflection of those pressure pulses. For example, in the method 10 as depicted in FIG. 1, a pressure pulse maybe transmitted through the fluid 34 (typically water, mud or brine) in the casing string 12 prior to cement being pumped into the casing, and reflected off of a float shoe 28 back through the fluid to the flowline 24. Since the distance from the transducer 26 to the float shoe 28 is known, the difference in time between the pressure pulse transmission (as detected at the transducer) and the pressure pulse being reflected back to the transducer may be readily measured, the speed (distance/time) of the pressure pulse through the fluid 34 may be accurately determined. Note that this information may be very useful later in the method 10 for accurately determining the cementing plug's location and/or displacement through the casing string 12.

A controller 30 or other computing device is used to actuate the valve 22 and to record the output of the transducer 26. The controller 30 may also be used for other functions, such as computing time differences, speeds and locations, and for relating these to various events in the cementing operation, such as the time of release of the cementing plug, etc. For example, if the controller 30 determines that the plug was released late, that is, that a volume of displacement fluid was pumped into the casing string 12 prior to the plug being released, then a calculation may be made as to when pumping of the displacement fluid should cease so that the displacement fluid below the plug is not forced into an annulus 32 between the casing string and the wellbore 14.

Figure 2:
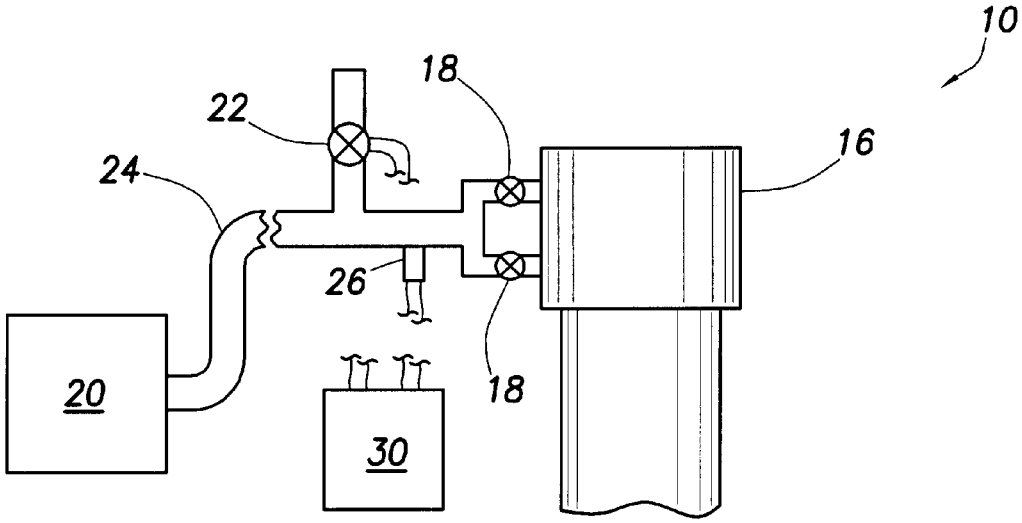
FIG. 2 is a schematic partially cross-sectional view of the method, wherein cement has been pumped into the casing string.
Figure 2:
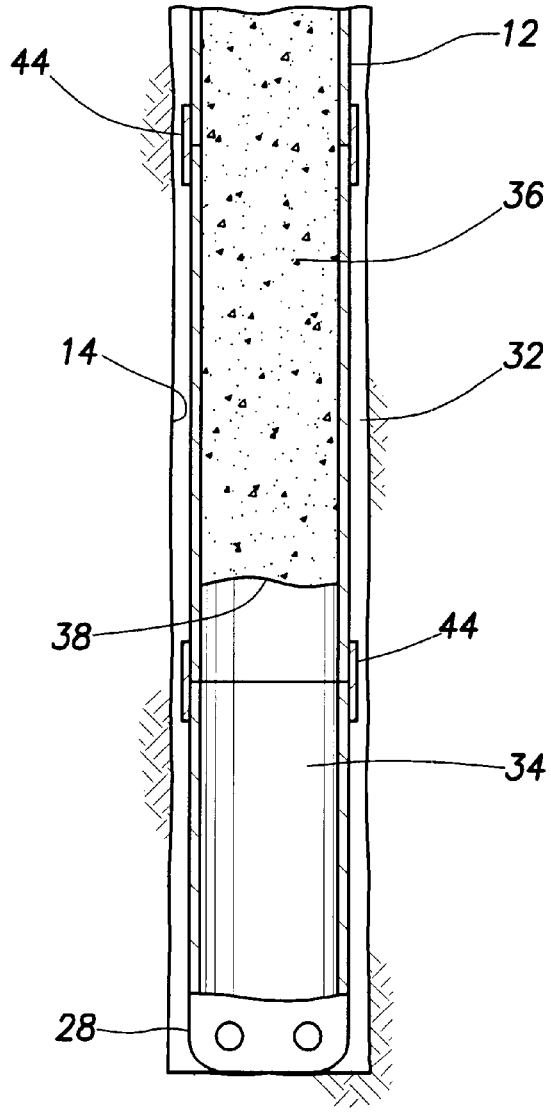

Referring additionally now to FIG. 2, the method lo is depicted wherein cement 36 has been pumped into the casing string 12. Note that at an interface 38 between the cement 36 and the fluid 34 a plug may be used to separate the cement from the fluid. This plug is not shown or described herein, but it is to be understood that the principles of the present invention may be used to determine this plug's location and/or displacement, as well as that of the plug as described below.

Figure 3:
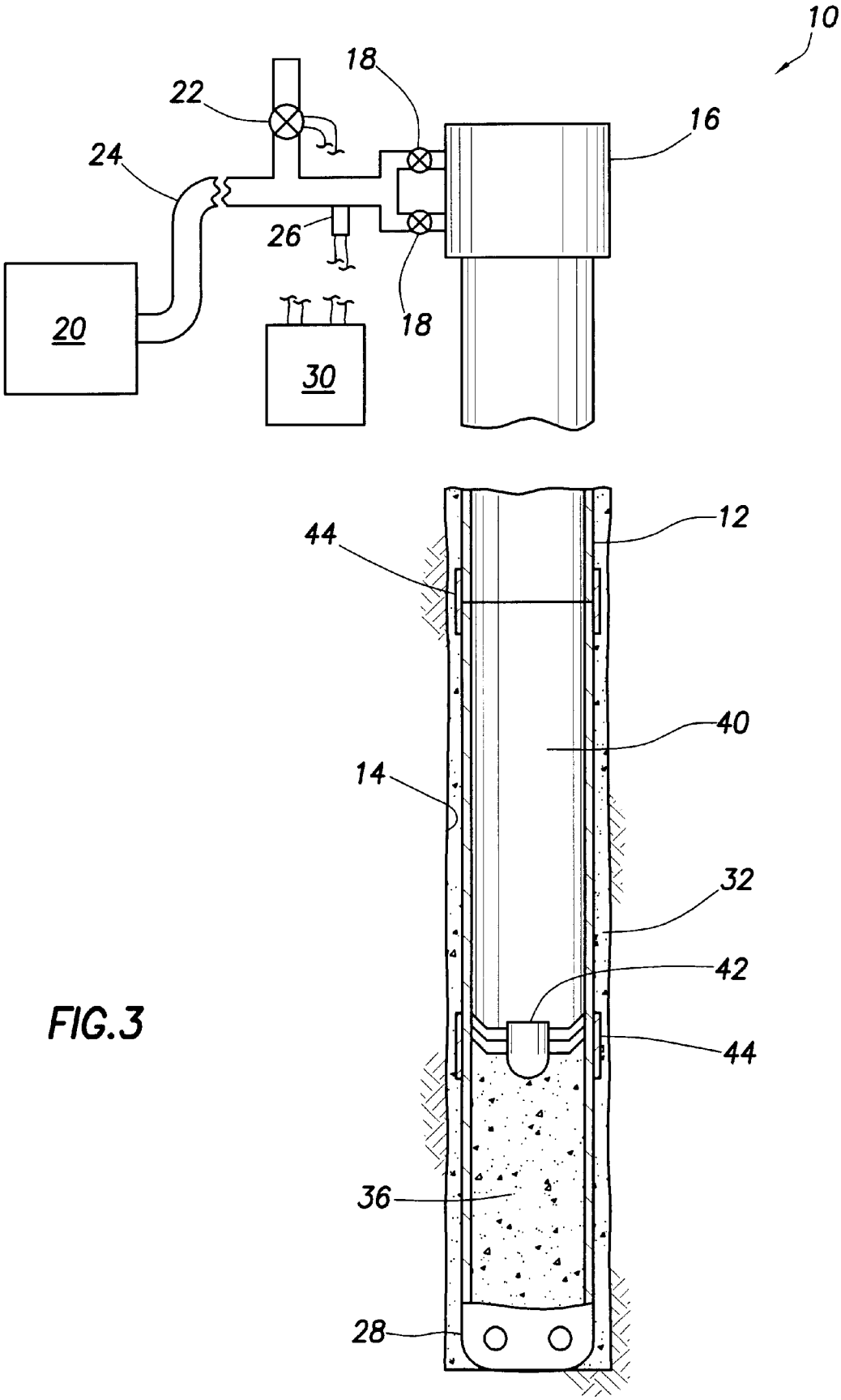
FIG. 3 is a schematic partially cross-sectional view of the method, wherein displacement fluid is being pumped into the casing string.

Referring additionally now to FIG. 3, the method lo is depicted wherein a plug 42 has been released from the release head 16 into the casing string 12 on top of the cement 36. Typically, the release of the plug 42 is accomplished by withdrawing a pin (not shown) in the release head 16 and manipulating the valves 18 to direct fluid on top of the plug and thereby push the plug out of the release head into the casing string 12.

A displacement fluid 40 is pumped by the pump 20 on top of the plug 42. The displacement fluid 40 is generally the same as the fluid 34 in the casing string 12 prior to the cement 36 being pumped into the casing string. Thus, the pressure pulse speed through the fluid 34 determined as described above is generally also the speed of a pressure pulse through the displacement fluid 40.

The plug 42 serves to separate the cement 36 from the displacement fluid 40, to force the cement through the shoe 28 and into the annulus 32, and to land in the shoe (or collar) and thereby provide an indication that all of the cement has been displaced out of the casing string 12. The location or position of the plug 42 may be readily determined in the method 10 by transmitting a pressure pulse through the displacement fluid 40 (e.g., by momentarily opening the valve 22). The pressure pulse will reflect off of the plug 42 and back to the transducer 26. Since the speed of the pressure pulse through the fluid 40 is accurately known, and the difference between the time the pressure pulse is transmitted (as detected by the transducer) and the time the pressure pulse is reflected back to the transducer may be measured by the controller 30, the location of the plug 42 can be readily computed (speed×time) at any point after the plug has been released.

If multiple pressure pulses are transmitted and reflected off of the plug 42 while it is being displaced through the casing string 12, then the displacement speed of the plug may be readily determined by dividing respective changes in distance by differences in time. Thus, during the pumping of the displacement fluid 40, an operator may be informed whether the plug 42 is appropriately displacing through the casing string 12 for the rate of displacement fluid being pumped. A slower than expected speed of the plug 42 might indicate that displacement fluid is leaking past the plug.

Figure 4:
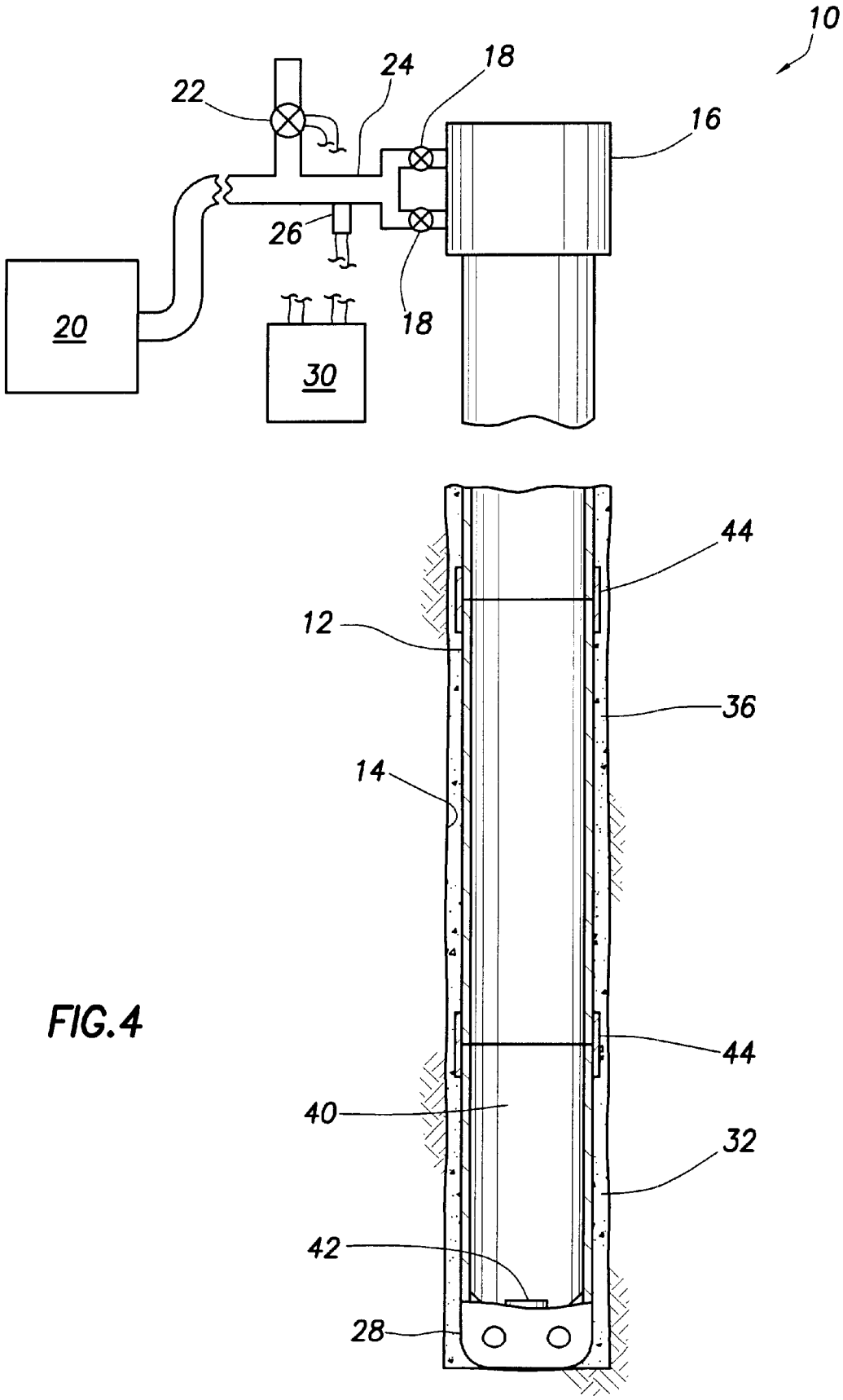
FIG. 4 is a schematic partially cross-sectional view of the method, wherein the cement has been displaced out of the casing string and a plug has been landed in a float shoe.

Referring additionally now to FIG. 4, the method 10 is depicted wherein the plug 42 has landed in the shoe 28 (or in a float collar associated with the shoe). It is usually expected that a pressure increase will accompany any further pumping of displacement fluid 40 into the casing string 12 after the plug 42 has landed in the shoe 28.

When such a pressure increase is detected, it may be desirable to determine the location of the plug 42, so that it may be known whether the plug has indeed landed in the shoe 28 (or collar), or has encountered some other obstruction in the casing string 12. The position of the plug 42 in the casing string 12 may be readily confirmed by transmitting a pressure pulse through the fluid 40, reflecting the pressure pulse off of the plug 42 and back to the transducer 26. The difference in time between transmitting the pressure pulse and receiving the reflected pressure pulse may then be used to compute the location of the plug 42.

If a prior determination of the location of the plug 42 has indicated that the plug was released late, that is, after a volume of displacement fluid 40 was pumped into the casing string 12, it may be desired to stop pumping the displacement fluid prior to the plug 42 landing in the shoe 28 (or collar). The location of the plug 42 may be confirmed as described above, and as often as desired, to ensure that the plug is positioned properly in the casing string 12 when pumping of the displacement fluid 40 is ceased.

Note that it is not necessary for the pressure pulse speed through the fluid 40 to be precisely known for the information received in the method 10 to be useful. For example, even if the pressure pulse speed is not known, displacement of the plug 42 through the casing string 12 may still be confirmed during pumping of the displacement fluid 40 by observing a succession of increased times for pulses to be reflected back to the transducer 26. A lack of an increase in times for successive reflected pulses would be an indication that the plug 42 has ceased displacing through the casing string 12. Furthermore, approximate pressure pulse speeds for various fluids (e.g., water, mud, brine, etc.) may be used to approximate a location for the plug 42 based on the time measured for a pulse to be reflected off of the plug.

Another method of estimating the location of the plug 42 may be used if there are anomalies at known locations in the wellbore 14, and the anomalies will also reflect the pressure pulses transmitted through the fluid 40. In the method 10, for example, the casing string 12 includes casing collars 44 interconnected at known intervals between individual joints of casing. Each of these collars 44 will reflect the pressure pulses back to the pressure transducer 26, although these reflections will be quite small in amplitude. By counting the number of these casing collar reflections that are received prior to receiving the pressure pulse reflected off of the plug 42, the number of casing collars 44 above the plug maybe determined. Since the lengths of the individual joints of casing are known, the depth of the plug 42 in the casing string 12 may be readily determined, for example, by multiplying the number of casing collars by the average casing joint length, or by summing the individual lengths of the corresponding casing joints. This method provides an estimate of the depth of the plug 42 in the casing string 12 accurate to within the length of one joint of casing.

Of course, a person skilled in the art would, upon a careful consideration of the above description of a representative embodiment of the invention, readily appreciate that many modifications, additions, substitutions, deletions, and other changes may be made to this specific embodiment, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of determining displacement of a device through a tubular string positioned in a well, the method comprising the steps of:

pumping a fluid into the tubular string;

displacing the device through the tubular string in response to the pumping step;

transmitting at least one pressure pulse through the fluid;

reflecting the pressure pulse off of the device; and receiving the reflected pressure pulse.

2. The method according to claim 1, wherein the transmitting, reflecting and receiving steps are performed during the pumping step.

3. The method according to claim 1, wherein multiple pressure pulses are transmitted through the fluid, reflected off of the device and received.

4. The method according to claim 3, further comprising the step of calculating a displacement of the device based on a time difference between received reflected pressure pulses.

5. The method according to claim 4, wherein the calculating step further comprises calculating the displacement further based on a known speed of the pressure pulses through the fluid.

6. The method according to claim 5, further comprising the step of transmitting a pulse through the fluid a known distance to thereby determine the known speed of the pressure pulses in the calculating step.

7. The method according to claim 1, wherein the device is a cementing plug separating the fluid from cement in the tubular string.

8. The method according to claim 1, wherein the receiving step further comprises receiving the transmitted pressure pulse, and further comprising the step of determining a time difference between the transmitted pressure pulse and the reflected pressure pulse.

9. The method according to claim 8, further comprising the step of calculating a position of the device based on the time difference between the transmitted pressure pulse and the reflected pressure pulse.

10. The method according to claim 9, wherein the calculating step further comprises calculating the position of the device based on a speed of the pressure pulses through the fluid.

11. The method according to claim 10, further comprising the step of determining the speed of the pressure pulses through the fluid by transmitting a pulse through the fluid a known distance prior to the pumping step.

12. A method of determining a location of a device in a tubular string, the method comprising the steps of:

pumping a fluid into the tubular string on top of the device, thereby displacing the device through the tubular string; and reflecting at least one pressure pulse off of the device through the fluid.

13. The method according to claim 12, further comprising the steps of transmitting the pressure pulse through the fluid and receiving the reflected pressure pulse.

14. The method according to claim 13, further comprising the step of recording a time difference between the transmitting and receiving steps.

15. The method according to claim 14, further comprising the step of determining the location of the device based on the time difference and a speed of the pressure pulse through the fluid.

16. The method according to claim 15, further comprising the step of determining the speed of the pressure pulse through the fluid by transmitting a pulse through the fluid a known distance prior to the pumping step.

17. A method of locating a cementing plug in a subterranean well, the method comprising the steps of:

pumping cement into a casing string;

releasing a plug into the casing string;

displacing the plug and cement through the casing string by pumping a fluid into the casing string on top of the plug; and reflecting at least one pressure pulse off of the plug through the fluid during the displacing step.

18. The method according to claim 17, wherein in the reflecting step, multiple pressure pulses are reflected off of the plug during the displacing step.

19. The method according to claim 18, further comprising the step of determining a displacement of the plug based on a time difference between the pressure pulses being reflected off of the plug.

20. The method according to claim 17, further comprising the step of determining a location of the plug based on a time difference between transmitting and receiving the pulse reflected off of the plug.

21. The method according to claim 17, further comprising the step of transmitting a pulse through the fluid in the casing string a known distance prior to the pumping step.

22. The method according to claim 21, further comprising the step of determining a speed of the pulse through the fluid based on a time the pulse travels the known distance through the fluid in the casing string.

23. A method of determining displacement of a device through a tubular string positioned in a well, the method comprising the steps of:

reflecting at least one pressure pulse off of the device while the device is displacing through the tubular string; and receiving the reflected pressure pulse.

24. The method according to claim 23, further comprising the steps of pumping a fluid into the tubular string and transmitting the pressure pulse through the fluid.

25. The method according to claim 23, wherein multiple pressure pulses are reflected off of the device.

26. The method according to claim 25, further comprising the step of calculating a displacement of the device based on a time difference between receiving the respective multiple reflected pressure pulses.

27. The method according to claim 26, wherein the calculating step further comprises calculating the displacement further based on a known speed of the pressure pulses through a fluid in the tubular string.

28. The method according to claim 27, further comprising the step of transmitting a pulse through the fluid a known distance to thereby determine the known speed of the pressure pulses in the calculating step.

29. The method according to claim 23, wherein the device is a cementing plug separating a fluid from cement in the tubular string.

30. The method according to claim 23, wherein the receiving step further comprises receiving the pressure pulse as the pressure pulse is transmitted, and further comprising the step of determining a time difference between the received transmitted pressure pulse and the received reflected pressure pulse.

31. The method according to claim 30, further comprising the step of calculating a position of the device based on the time difference between the received transmitted pressure pulse and the received reflected pressure pulse.

32. The method according to claim 31, wherein the calculating step further comprises calculating the position of the device based on a speed of the pressure pulses through fluid in the tubular string.

33. The method according to claim 32, further comprising the step of determining the speed of the pressure pulses through the fluid by transmitting a pulse through the fluid a known distance.

34. The method according to claim 23, wherein the reflecting step further comprises reflecting the pressure pulse off of at least one anomaly in the well other than the device, and wherein the receiving step further comprises receiving the pressure pulse reflected off of the anomaly.

35. The method according to claim 34, further comprising the step of determining the displacement of the device in the well by relating the pressure pulse as reflected off of the device to the pressure pulse as reflected off of the anomaly.

36. The method according to claim 34, wherein in the reflecting step, the pressure pulse is reflected off of multiple anomalies in the well, and further comprising the step of determining the displacement of the device in the well by counting a number reflections of the pressure pulse off of the anomalies received prior to receiving the reflection of the pressure pulse off of the device.

37. The method according to claim 36, wherein the determining step further comprises multiplying the number of anomaly reflections by an average spacing between the anomalies in the well.

38. The method according to claim 36, wherein the determining step further comprises summing anomaly spacings corresponding to the anomalies for which the number of anomaly reflections were counted in the counting step.

39. A method of determining a location of a device in a well, the method comprising the steps of:

transmitting at least one pressure pulse in the well;

reflecting the pressure pulse off of the device and off of at least one anomaly other than the device, wherein a position of the anomaly in the well is known;

receiving the device reflection and the anomaly reflection; and determining the location of the device based on the known position of the anomaly and a relationship between the device and anomaly reflections.

40. The method according to claim 39, wherein in the reflecting step multiple anomalies are positioned in the well, in the receiving step multiple anomaly reflections are received, and in the determining step the location of the device is based in part on the relationship between the device reflection and the multiple anomaly reflections.

41. The method according to claim 40, wherein in the reflecting step spacings between each of the anomalies in the well are known.

42. The method according to claim 39, wherein in the reflecting step the pressure pulse is reflected off of multiple anomalies in the well, and wherein the determining step further comprises determining the location of the device in the well by counting a number reflections of the pressure pulse off of the anomalies received prior to receiving the reflection of the pressure pulse off of the device.

43. The method according to claim 42, wherein the determining step further comprises multiplying the number of anomaly reflections by an average spacing between the anomalies in the well.

44. The method according to claim 42, wherein the determining step further comprises summing anomaly spacings corresponding to the anomalies for which the number of anomaly reflections were counted in the counting step.

45. The method according to claim 39, wherein the device is a cementing plug and there are multiple anomalies positioned in the well, the anomalies being casing collars, and wherein the determining step further comprises determining the location of the plug in the well by counting a number reflections of the pressure pulse off of the casing collars received prior to receiving the reflection of the pressure pulse off of the plug.

* * * * *

UNITED STATES PATENT AND TRADEMARK OFFICE

CERTIFICATE OF CORRECTION

PATENT NO. : 6,401,814 B1
DATED : June 11, 2002
INVENTOR(S) : Owens et al.

It is certified that error appears in the above-identified patent and that said Letters Patent is hereby corrected as shown below:

Title page,
Item [54], "METHOD OF LOCATING A CEMENTING PLUG IN A SUBTERRANEAN WALL" should be -- METHOD OF LOCATING A CEMENTING PLUG IN A SUBTERRANEAN WELL --

Signed and Sealed this

Fifteenth Day of October, 2002

*Attest:*

*Attesting Officer*

JAMES E. ROGAN
*Director of the United States Patent and Trademark Office*